United States Patent [19]

Molins et al.

[11] 4,287,979

[45] Sep. 8, 1981

[54] METHOD AND APPARATUS FOR ASSEMBLING ROD-LIKE ARTICLES

[75] Inventors: Desmond W. Molins; Brian H. Warner, both of London, England

[73] Assignee: Molins Limited, London, England

[21] Appl. No.: 815,197

[22] Filed: Jul. 12, 1977

[30] Foreign Application Priority Data

Jul. 22, 1976 [GB] United Kingdom ..... 30534/76

[51] Int. Cl.[3] ..... B65G 47/29

[52] U.S. Cl. ..... 198/425; 131/94; 198/493

[58] Field of Search ..... 198/420, 425, 493, 616; 131/94; 93/1 C, 77 FT; 302/2 R, 11, 31

[56] References Cited

U.S. PATENT DOCUMENTS

| | | | |
|---|---|---|---|
| 2,798,495 | 7/1957 | Molins | 131/94 |
| 2,912,987 | 11/1959 | Molins et al. | 131/94 |
| 2,957,285 | 10/1960 | Molins | 93/1 C |
| 2,990,831 | 7/1961 | Molins | 131/94 |
| 3,009,557 | 11/1961 | Jackson | 198/420 |
| 3,059,651 | 10/1962 | Molins et al. | 131/94 |
| 3,131,612 | 5/1964 | Rowlands | 93/1 C |

FOREIGN PATENT DOCUMENTS

| | | | |
|---|---|---|---|
| 2403531 | 7/1975 | Fed. Rep. of Germany | 198/616 |

*Primary Examiner*—Jeffrey V. Nase
*Attorney, Agent, or Firm*—Craig and Antonelli

[57] ABSTRACT

Spaced groups of component filter portions for forming into composite filter rods are assembled by retarding selected portions of the stream by means of transversely-applied suction. The suction means may include a rotary valve operable periodically to connect a suction manifold to a suction outlet adjacent the path of the stream. The stream may be formed and conveyed at an endless band which receives the portions indirectly from a hopper via a fluted drum. The hopper may incorporate an additional feed band which agitates the rods in the hopper to ensure that each flute of the fluted drum receives a rod.

11 Claims, 15 Drawing Figures

Figure 2:
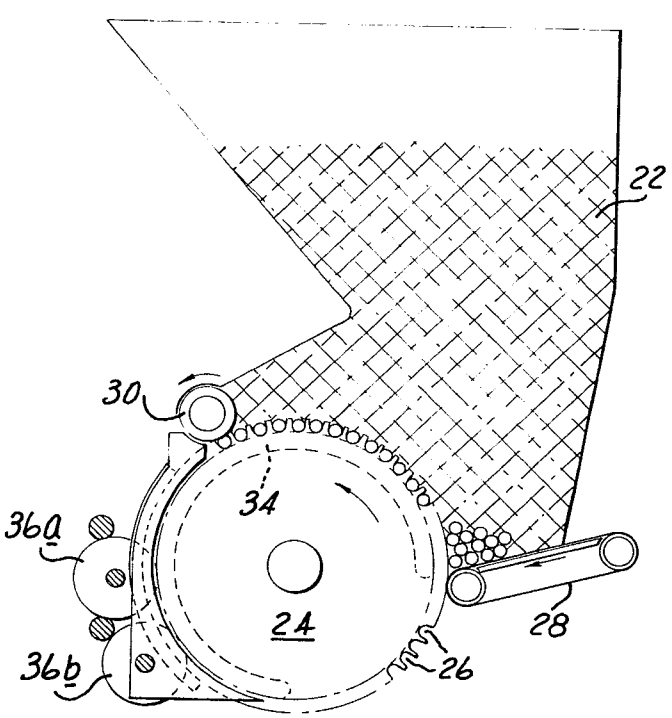

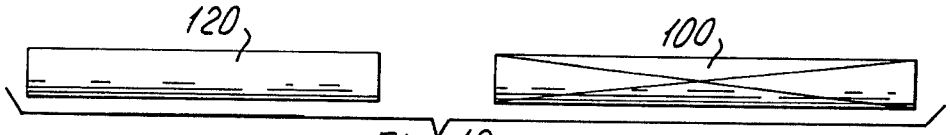
Fig. 12.
Fig. 13.
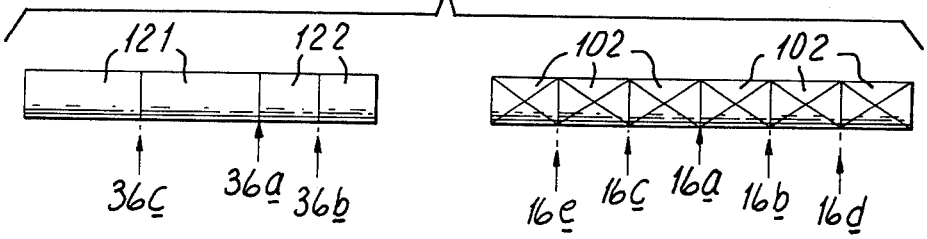
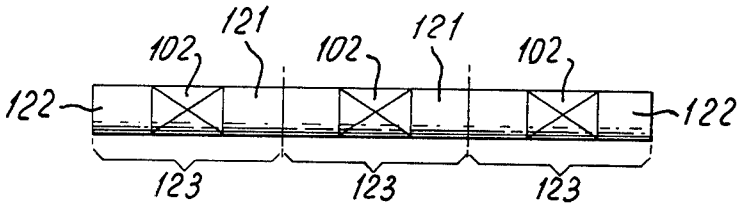
Fig. 14
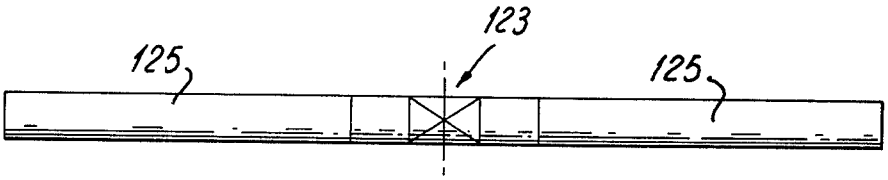
Fig. 15.

METHOD AND APPARATUS FOR ASSEMBLING ROD-LIKE ARTICLES

This invention relates to apparatus for assembling rod-like articles. The invention is applicable to the formation of a composite filter rod, from which composite filters, for incorporation in filter cigarettes, can be obtained by cutting the rod at appropriate positions.

It is known to form a composite filter rod by assembling filter portions of different materials in an alternating stream and continuously feeding the stream into the garniture of a continuous rod filter making machine where it is enclosed in a continuous wrapper web. It is also known to assemble alternating filter portions in aligned groups which are conveyed transversely to their lengths and a precut piece of wrapper material rolled and sealed around each group to form a composite filter rod. The present invention is concerned particularly, but not exclusively, with the assembly of groups of component filter portions, which may subsequently be formed into composite filter rods by uniting the components of each group.

One aspect of the invention provides apparatus for assembling rod-like articles, comprising conveyor means for conveying a stream of rod-like articles in an endwise direction; and means for applying suction transverse to said stream to retard predetermined articles of said stream relative to said conveyor means and subsequently to release said articles after a predetermined period, so that said conveyor means conveys spaced groups of abutting articles downstream of said suction means. The suction means may comprise a rotary valve. The rod-like articles may comprise component filter portions delivered onto a suction band conveyor. Where the method is used for the assembly of groups of two different types of component filter portion one type is fed onto the conveyor at one position and the other type is fed onto the conveyor at a position downstream of said one position so that the different filter portions intercalate on said conveyor. The suction means is conveniently driven in timed relationship with the feed means for the type of filter portion which will form the leading portion of a group.

The rod-like articles conveyed towards the retarding means, by which they are formed into abutting groups, may be subjected to an air stream having a component in their direction of travel and tending to close up gaps between said articles.

Suction retarding means and/or an air stream moving over the conveyor towards retarding means in general is applicable to feed apparatus for component filter portions as disclosed in British patent specification No. 971,491.

Component filter portions for delivery to feed apparatus as previously described are normally obtained by cutting rod lengths while they are conveyed in a fluted drum which receives the lengths, directly from a hopper. In order that the subsequent feed apparatus should operate correctly it is important that every flute of the drum should be filled. According to another aspect of the present invention apparatus for assembling rod-like articles comprises conveyor means for conveying a stream of rod-like articles in an endwise direction; means for controlling the spacing of said articles on the conveyor means; and means for feeding said articles onto the conveyor means, said feeding means including a reservoir for rod-like articles, a fluted drum arranged to receive articles directly from the reservoir, a band conveyor forming a lower wall of said reservoir, said band conveyor being drivable so as to tend to move articles towards the fluted drum and in the same sense as the fluted drum, and means for stripping articles from the fluted drum and delivering them endwise towards said conveyor means. A preferred form of band conveyor is provided with at least one projection which tends to agitate the articles in the reservoir as the conveyor is moved. Such an arrangement has been found to provide effective filling of the flutes of the drum. Other measures which may be taken to improve filling of the flutes are providing contact between the drum and the reservoir over a large angle of rotation of the drum and supplying suction to the flutes of the drum.

It is to be noted that those aspects or parts of the present invention which are not specific to the formation of groups of rod-like articles may be used in an in-line arrangement for producing a continuous rod in a garniture, as for example in the production of composite filter rod according to the disclosure of British patent specification No. 971,491.

Figure 1:
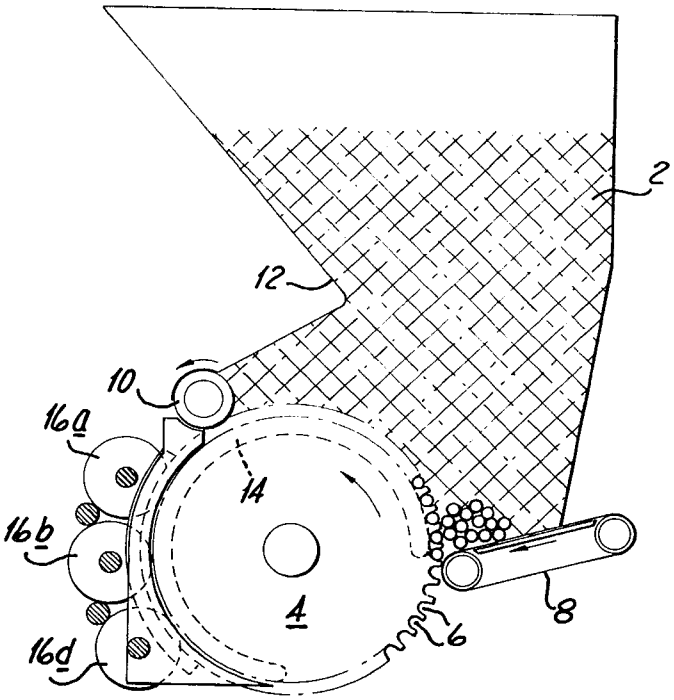
Figure 3:
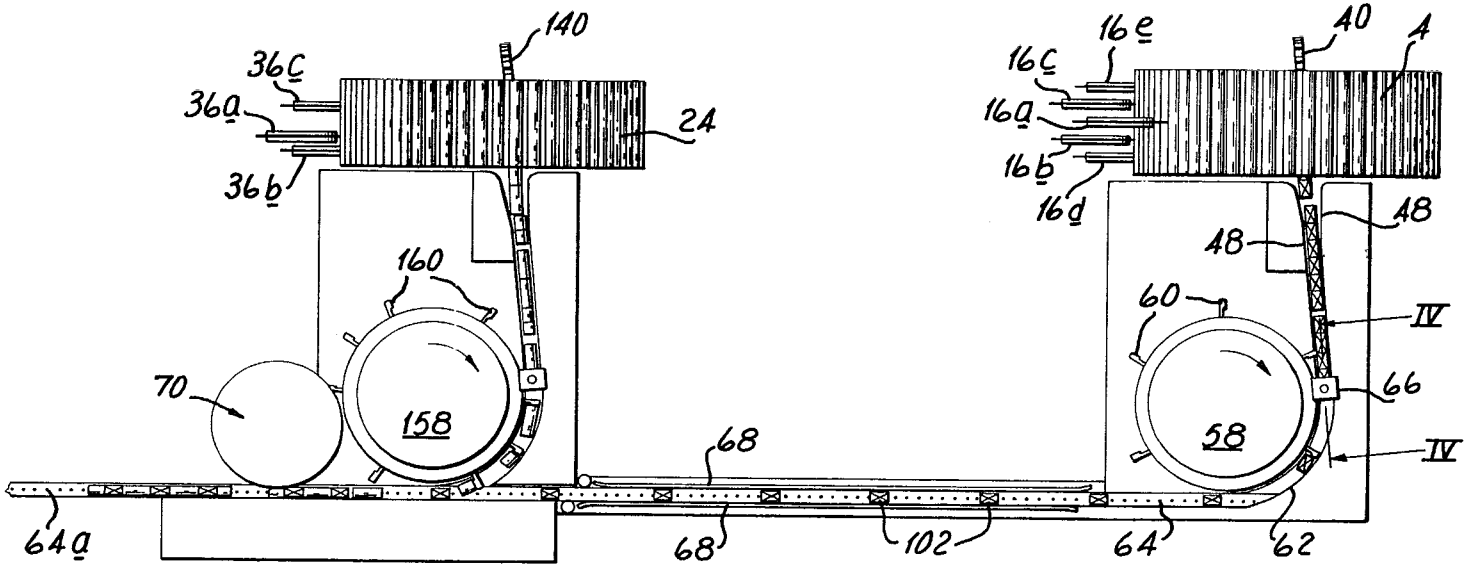
Figures 4, 5:
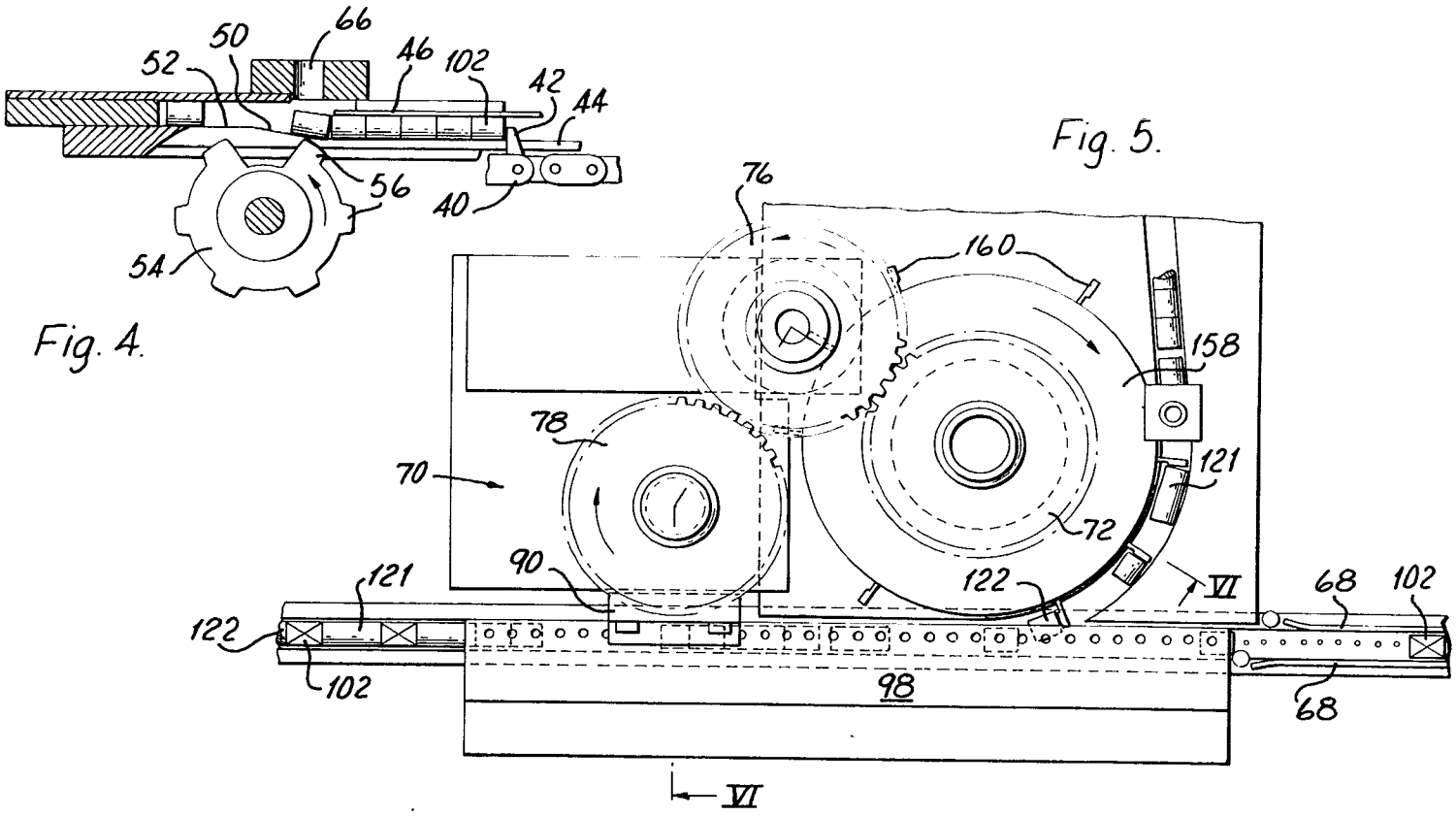
Figure 6:
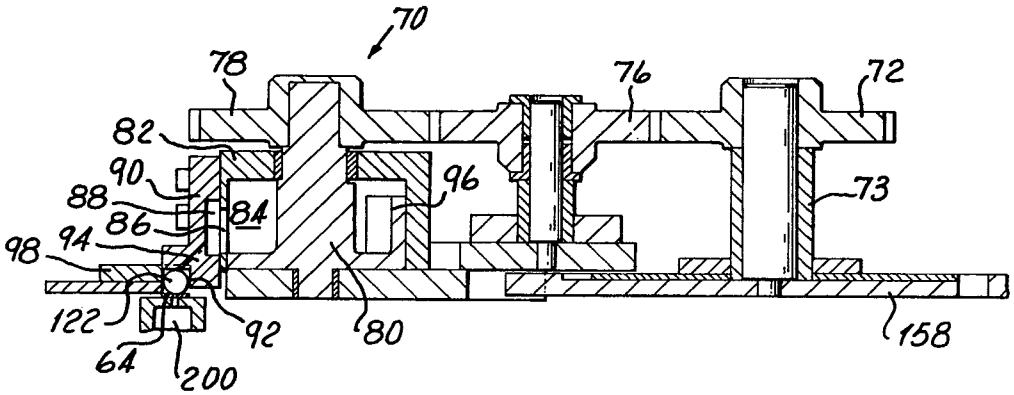
Figure 7:
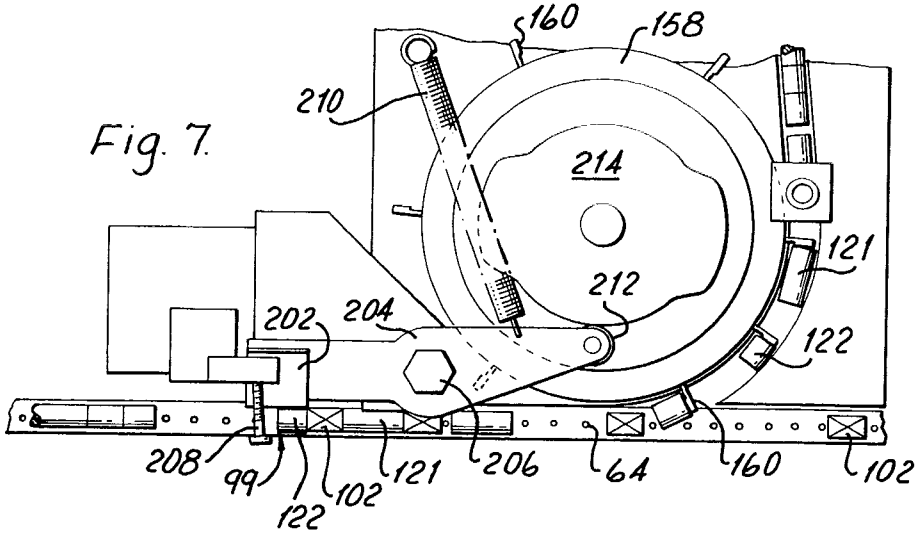
Figure 8:
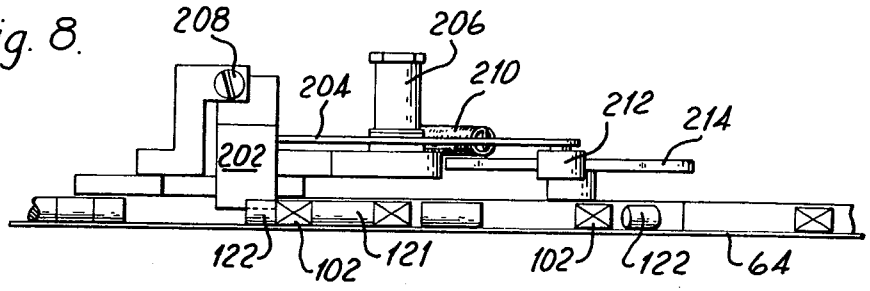
Figure 11:
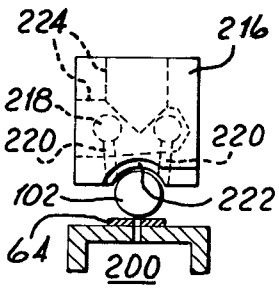
Figure 9:
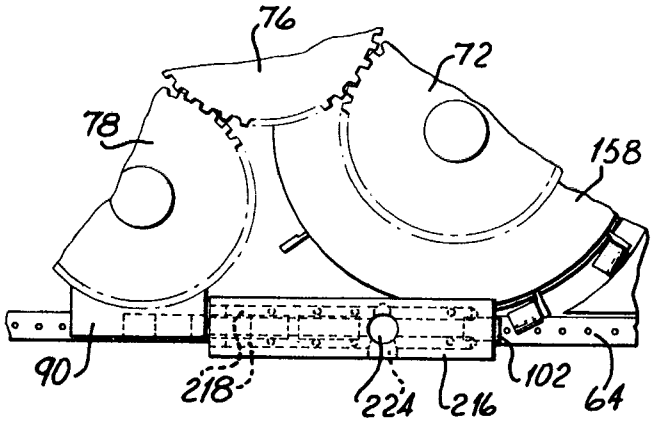
Figure 10:
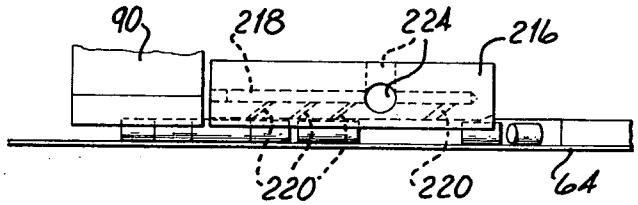

The invention will now be further described, by way of example only, with reference to the accompanying drawings, in which:

FIG. 1 is a sectional view of a hopper for rod lengths of one type of filter material, FIG. 2 is a sectional view of a hopper for rod lengths of another type of filter material, FIG. 3 is a diagrammatic plan view of apparatus for assembling groups of component filter portions obtained from rod lengths supplied by the hoppers of FIGS. 1 and 2, FIG. 4 is an enlarged sectional view on the line IV—IV in FIG. 3, FIG. 5 is a plan view of part of the apparatus of FIG. 3, FIG. 6 is a sectional view on the line VI—VI of FIG. 5, FIG. 7 is a plan view of a modification of part of the apparatus of FIG. 3, FIG. 8 is a side view of the apparatus shown in FIG. 7, FIG. 9 is a plan view of another modification of part of the apparatus of FIG. 3, FIG. 10 is a side view of the apparatus shown in FIG. 9, FIG. 11 is a sectional view on the line XI—XI of FIG. 10, FIG. 12 is a diagram showing a rod length from each of the hoppers of FIGS. 1 and 2, FIG. 13 is a diagram indicating how each of the rod lengths of FIG. 12 is divided into component filter portions, FIG. 14 is a diagram of a group of component filter portions, and FIG. 15 shows an assemblage comprising a double length composite filter portion placed between two tobacco filler lengths.

FIG. 1 shows a hopper 2 for receiving and holding rod-lengths of a first type of filter material, such as a tow of cellulose acetate fibres. The hopper 2 is arranged to supply rod lengths to a drum 4 having flutes 6. The drum 4 can receive rod lengths from the hopper 2 over a substantial arc of its rotation. The lower part of the hopper 2 has a base wall comprising a driven band 8 which defines one boundary of said arc. The other boundary is defined by a refuser roller 10. The hopper 2 has a re-entrant side wall 12 over the region adjacent the refuser roller 10. The flutes 6 of the drum 4 receive suction from a manifold 14.

The apparatus so far described is adapted to supply rod lengths from the hopper 2 at a high delivery rate (up to 2500 rod lengths/minute). In achieving this several factors are considered relevant. The drum 4 receives rod lengths over a large arc, so that the possibility of a flute 6 passing the hopper 2 without receiving a rod length is reduced. In addition suction from the manifold 14 provides more positive capture of rod lengths in the flutes 6. The band 8, which is typically driven at a speed which is about $\frac{1}{3}$ to $\frac{2}{3}$ of the peripheral speed of the drum 4, causes some agitation of the rod lengths in the lower region of the hopper so that the tendency for bridging to occur is reduced. In order to provide additional agitation the band 8 may be provided with one or more projections: the presence of a lap joint in the band has proved useful in this respect. Furthermore, the shape of the hopper 2, having a re-entrant wall 12 which defines a restricted width region for the hopper and which prevents a large mass of rod lengths bearing directly on the trailing region of the arc over which the drum 2 receives rod lengths, has been found advantageous. The hopper 2 is in fact of reduced capacity compared with more conventional hoppers in similar systems: this would rarely be a disadvantage, particularly since the rod lengths would normally be supplied to the hopper by a high speed pneumatic conveying system, and has the advantage of reducing the overall size of the apparatus.

The drum 4 is provided with five peripheral grooves, into which project five rotary cutting knives 16*a*, 16*b*, 16*c*, 16*d* and 16*e* (see also FIG. 3). A rod length 100 delivered by the hopper 2 and carried in a flute 6 is shown in FIG. 12. This rod is divided into six equal length component filter portions 102 by the knives 16 in the sequence indicated in FIG. 13. Typically the rod 100 may be 72 mm long so that each portion 102 has a length of 12 mm.

A hopper 22 for rod-lengths of a second type of filter material, such as myria or other paper-like material is shown in FIG. 2. The hopper 22 supplies rod lengths to a fluted drum 24 in the same way as the hopper 2 supplies rods to the drum 4, and has a driven band 28 and refuser roller 30.

The drum 24 is similar to the drum 4 and has flutes 26 which receive suction from a suction manifold 34. However, the drum 24 is provided with only three peripheral grooves, into which project three rotary cutting knives 36*a*, 36*b* and 36*c* (see also FIG. 3). A rod length 120 delivered by the hopper 22 and carried in a flute 26 is shown in FIG. 12. This rod is divided into two long component filter portions 121 and two short component filter portions 122 by the knives 36 in the sequence indicated in FIG. 13. Typically the rod 120 may be 60 mm long and the portions 121 and 122 of length 20 mm and 10 mm respectively.

The hoppers 2 and 22 and the drums 4 and 24 form part of the apparatus shown in FIG. 3. The component filter portions obtained by severing the rods 100 and 120 in the drums 4 and 24 respectively are maintained under suction control from the respective manifolds 14 and 34 up to a release position at the bottom of each drum. Referring particularly to the arrangement associated with the drum 4, a chain conveyor 40 having extending lugs or pusher members 42 (see FIG. 4) passes beneath the drum at this release position. The conveyor 40 is inclined to the axis of the drum 4 and a lug 42 on the upper run of the conveyor can extend upwardly into the lowermost flute 6. The conveyor 40 and is arranged so that a lug 42 can enter the lowermost flute 6 and pass through it, due to its component of motion in the direction of motion of the flute. The lugs 42 are spaced apart on the conveyor 40 so that successive lugs enter and pass through successive flutes 6.

A slotted lower guide plate 44 (FIG. 4) is provided to support component filter portions 102 which are fed endwise in line by the lugs 42. An upper guide plate 46 and side walls 48 (FIG. 3) are also provided. The guide plate 44 has an upwardly inclined portion 50 which leads to a further horizontal guide surface 52 at a higher level.

A disc 54 having equally spaced fingers 56 is mounted so that on rotation successive fingers 56 will register with successive portions 102 conveyed in groups of six by the lug 42. Mounted alongside the guide plate 44 is a rotatable turntable 58 (FIG. 3) provided with six equally spaced pushers 60. The speed of rotation of the turntable 58 and the timing of the pushers 60 are so related to the speed and timing of the conveyor 40 and lugs 42, as well as the fingers 56, that a pusher 60 moves across the surfaces 50 and 52 each time a filter portion 102 has been moved upwardly by the surface 50 and a finger 56. The surface 52 extends alongside the turntable 58 and an arcuate guide surface 62 is provided so that an arcuate path around the turntable is provided for the portions 102. The pushers 60 convey the portions 102 around this arcuate path and subsequently transfer them at regular intervals onto a suction conveyor tape 64.

The arrangement described above with reference to FIGS. 3 and 4 is somewhat similar to an arrangement disclosed in British patent specification No. 876,732, to which reference is directed for a more detailed description.

In the arrangement according to the above-mentioned specification (and also in the similar arrangement described in British patent specification No. 971,491) the throat between the side walls corresponding to the present side walls 48, and into which the filter portions are conveyed from the hopper drum, is relatively wide. In the present arrangement, where the use of short filter portions having a length of 12 mm and less is contemplated, it has been found advantageous to use a restricted width throat between the side walls 48. This helps to prevent these short filter portions turning sideways as they leave the flutes 6. No particular problems have been experienced due to the reduced registration time between the flutes and the throat, even at high operating speeds.

In order to aid displacement of the filter portions 102 out of line by the ramp 50 and fingers 56 suction lift may be provided so that the actual work performed by the fingers 56 is reduced. This can provide a more positive movement and help prevent possible damage to the portions caused by the fingers 56, especially at high operating speeds. In some circumstances it may be possible to dispense with the disc 54 and fingers 56 and reply simply on suction, which may be timed. Means for applying suction in the region above the ramp 50 is indicated at 66 in FIGS. 3 and 4. The application of suction has the additional advantage of cleaning the region of any loose particles which may have been released by the component filter portions.

An arrangement similar to that shown in FIGS. 6 and 7 of U.S. Pat. No. 4,040,430 which is referred to in its entirety, may be used for separating the portions delivered by the conveyor 40 instead of the arrangement shown in present FIGS. 3 and 4.

While the conveyor 40 has been described as a chain link conveyor it is possible to use a composite plastics timing belt provided with spaced pusher members equivalent to the lugs 42.

The feed arrangement from the drum 24 is generally similar to that from the drum 4 with minor modifications to take account of the different lengths of the component filter portions 121 and 122. The feed comprises a conveyor 140 and a turntable 158 having spaced pushers 160 which transfer the portions onto the conveyor 64 at a position downstream of the turntable 58.

The pushers 160 are not spaced evenly on the turntable 158 and in fact comprise two groups of four so that the turntable conveys the filter portions from two rods 120 during one revolution. The irregular spacing of the pushers 160 is a consequence of the unequal lengths of the portions 121 and 122 and also of the particular spacing of the portions required on the conveyor 64. It should be noted that the disc (corresponding to the disc 54) associated with the turntable 158 also has irregularly spaced fingers so that the component filter portions 121 and 122 are correctly displaced for pick-up by a finger 160.

As shown in FIG. 3 regularly spaced component filter portions 102 are conveyed on the conveyor 64 from the turntable 58. The conveyor 64 passes between side rails 68 which help to prevent possible displacement or misalignment of the portions 102. The turntable 158 is timed relative to the turntable 58 so that the portions 121 and 122 are inserted (intercalated) into the spaces between the portions 102. The delivery from the turntable 158 is such that every third space receives two spaced portions 122 and the other two spaces each receive a portion 121. Thus each space between the first filter portions 102 receives an equal length of second filter portion since the portions 121 are twice the length of the portions 122. It should be noted that in order to maintain correct intercalation of the first and second component filter portions on the conveyor 64 the turntable 158 has to rotate at twice the rate of the turntable 58.

After intercalation there are still gaps between each of the component filter portions in the stream on the conveyor 64. In order to close these gaps up and produce groups of component filter portions for forming into composite filter rods timed braking means, indicated diagrammatically at 70 in FIG. 3, is provided to retard the selected leading component filter portion of a group so that the conveyor 64 moves underneath this portion and the following component filter portions are successively brought into abutment. The braking means is operated for a predetermined period, just sufficient to allow a selected group of component filter portions to move into abutment, and then released so that the group as a unit is subsequently conveyed by the conveyor 64. The braking means is operated again after a predetermined interval to retard the component filter portion immediately following the group.

Braking means 70, which uses suction to retard filter portions on the conveyor 64, is illustrated in FIGS. 5 and 6. A gear wheel 72 is connected to a spindle 73 which is coaxial with and rotatable with the turntable 158. The gear wheel 72 meshes with an idler gear wheel 76 which in turn meshes with a further gear wheel 78 which is keyed to a rotor 80 rotatable in a fixed cylindrical housing 82 defining a suction chamber 84. The housing 82 includes an opening 86 leading into a chamber 88 in a member 90 which partly surrounds the housing in the region of the opening and which has an arcuate surface 92 positioned adjacent the conveyor 64 (see FIG. 6). The chamber 88 is connected to the surface 92 by a passage 94. The rotor 80 is provided with two opposite arcuate positions 96, (only one of which is shown in the drawings) which are a close fit within the member 90 and which each block the opening 86 for a predetermined angle of rotation during each revolution of the rotor.

The connection between the turntable 158 and the rotor 80 is such that suction is applied through the opening 86, chamber 88 and passage 94 to arrest axial movement of and hold the trailing filter portion 122 of each pair of portions 122 on conveyor 64, so that said trailing filter portion 122 becomes the leading component filter portion of a group. Suction is maintained to hold said portion 122 against the surface 92 while the conveyor 64 moves underneath it and successive further components of a group are brought into abutment behind it. A complete group is shown in FIG. 14 and comprises the leading portion 122 followed by two pairs of alternating portions 102 and 121, a further portion 102 and finally the leading filter portion 122 of the next pair of portions 122. The timing of the rotor 80 is such that as soon as the group as shown in FIG. 14 becomes abutted the opening 86 is blocked so that suction on the leading portion 122 is released and the group is carried away by the conveyor 64. The opening 86 remains blocked until the next trailing filter portion 122 (i.e. of a pair of adjacent portions 122) moves under the surface 92 when suction is again applied to hold it as a portion 96 of the rotor 80 moves away from the opening 86. Two opposite portions 96 of the rotor 80 are provided since there is no reduction in the gearing between the turntable 158 and the rotor 80 and two groups are conveyed for each revolution of the turntable.

As shown in FIGS. 5 and 6 in particular, a shroud 98 is provided in the region where intercalation takes place so that additional guidance is available for the filter portions on the conveyor 64. In addition, the conveyor 64 runs on a surface forming an upper wall of an enlarged suction chamber 200 so that increased suction can be applied in the area of intercalation to provide more positive control. The suction applied through the passage 94 must of course be sufficient to overcome suction applied through the conveyor band 64.

The application of suction to the passage 94 (and the removal thereof) cannot be instantaneous. It may be preferable to provide several smaller passages which receive suction in turn in order to arrest the movement of the leading filter portion in a more controlled manner. Moreover, since the movement of the rotor 80 is generally parallel to that of the conveyor 64 an undesirable suction gradient may exist across the passage 94 in the direction of the conveyor 64 during movement of a portion 96 across the opening 86. One possible way of avoiding this effect is to arrange for the rotor to rotate about a different axis, preferably an axis parallel to the length of the conveyor 64, so that the tendency of any suction gradient to drag filter portions backwards or forwards on the conveyor 64 would be reduced.

A mechanical brake for forming groups of component filter portions is shown in FIGS. 7 and 8. This comprises a clamping member 202 mounted at one end of a lever 204 which is pivoted on a fixed spindle 206. The lever 204 is normally maintained in contact with an adjustable stop 208 by means of a tension spring 210 so that the leading filter portion of a group is lightly clamped against a side wall 99 forming part of the shroud 98. The other end of the lever carries a roller 212 which is displaceable by a cam 214. The cam 214 is mounted for rotation with the turntable 158 and is shaped so that the roller 212 is displaced twice every revolution. This has the effect of moving the clamping member 202 by a sufficient distance to release the filter portion. The formation of groups on the conveyor 64 using the mechanical brake of FIGS. 7 and 8 is the same as the formation using the suction brake of FIGS. 5 and 6. An alternative form of mechanical brake which could be used is disclosed in British patent specification No. 917,701.

Whichever form of retarding means is used there is the possibility, especially at high operating speeds, that the rearmost filter portion or portions in a group will not be completely abutted at the time the brake releases the group to be carried away by the conveyor 64. Where this condition is present the cause is normally bounce of the rearmost filter portion or portions. While slight gaps between components of a group can be tolerated subsequent handling of the groups is easier if these gaps are kept to a minimum.

One device aimed at reducing the occurrence of gaps is shown in FIGS. 9, 10 and 11. This device comprises a moulding 216 of plastics material mounted over the conveyor 64 in the region upstream of the braking means. In FIGS. 9 to 11 the device is shown in use with a suction braking means of the type illustrated in FIGS. 5 and 6 and is arranged immediately adjacent to the member 90. The moulding 216 contains two parallel axial chambers 218 and a number of inclined bores 220 leading from these chambers to the sides of an arcuate groove 222 on the lower surface of the moulding. Larger bores 224 extend from the upper and side surfaces of the moulding 216 and communicate with the chambers 218. Air under pressure (either continuous or in pulses) may be supplied to one of the bores 224 (the other being blocked) so that air admitted to the chambers 218 is expelled through the inclined bores 220. The streams of air from these bores 220 have components along the direction of movement of the conveyor 64 and thus urge filter portions in this direction independently of the conveyor. The rearmost of the bores 220 are slightly wider that the other bores 220.

Referring once again to FIG. 3 groups of component filter portions released by the brake means 70 move on to the region 64*a* of conveyor 64 and each group is subsequently united in any convenient manner to form a composite filter rod. For example, successive groups may be transferred from the region 64*a* onto a series of drums on which each group is rolled and sealed in one or more uniting bands. One method of forming a composite filter rod in which several relatively narrow uniting bands are used to unite a group is disclosed in U.S. Pat. No. 4,093,496. Another similar method which may be used is disclosed in U.S. Pat. No. 4,103,596 which also discloses an arrangement suitable for transferring the groups from the region 64*a* of the conveyor onto a drum. In fact, the latter application describes a system in which groups of component filter portions are formed in a manner analagous to that described in the present application. The particular arrangement of the present application may be incorporated in the system described in said application.

FIG. 14 shows a group of component filter portions as formed by the present apparatus. The group is united into a composite filter rod by wrapping in one or more uniting bands. The uniting band or bands may span the whole length of each group or separate uniting bands may span adjacent end portions only of each pair of filter portions in the group. Alternatively, since the portions 102 are only 12 mm long, a compromise arrangement may be used in which three uniting bands span the whole length of each portion 102 and overlap onto the adjacent portions 121 or 121 and 122. This still provides a considerable saving in width of uniting band material.

Composite filter rods produced from groups as shown in FIG. 14 are passed to a machine for assembling filter cigarettes where they are divided into three double length composite filters 123, as shown in FIG. 14. In this machine each filter 123 is placed between and joined to two tobacco filter lengths 125 as shown in FIG. 15. The resulting assemblage is divided at its midpoint to produce two individual filter cigarettes, each having a composite filter which comprises, in the present case, 10 mm of the second filter material adjacent to the tobacco and 6 mm of the first filter material at the exposed end.

The arrangement of component filter portions in a group, the lengths of the various components, and the overall length of a group are not restricted to those of the group shown in FIG. 14. For example in one proposal each group comprises fifteen components rather than seven. In this case the lengths of the rods in the hoppers 2 and 22 are increased and more cutting knives 16 and 36 supplied. It is proposed in one arrangement that the hoppers and their associated drums should be adaptable to deal with rod lengths varying from 48 mm to 155 mm.

The illustrated apparatus is primarily intended for forming separate groups of component filter portions for forming into composite filter rods but it is not restricted to use in this manner. For example, braking means could be operated to substantially close up all the gaps between the component filter portions so that a continuous stream of said portions on the conveyor 64 could be supplied to a garniture for forming into composite filter rod in a conventional in-line process such as that described in British patent specification No. 971,491. An in-line process could still be used without closing up all the gaps where, for example, it is intended to introduce granulated filter material between component filter portions.

We claim:

1. Apparatus for assembling rod-like articles, the apparatus comprising endless band conveyor means for conveying a stream of rod-like articles in an endwise direction; guide means spaced above and extending along said conveyor means, said guide means including a surface having an arcuate cross section adapted to partly surround a plurality of articles in said stream so as to guide and align the plurality of the articles on said conveyor means, said surface having a predetermined axial length so as to extend from a leading edge of one of said articles to a trailing edge of at least one other abutting article of said plurality of articles; at least one suction outlet in said surface; and means for applying suction to said outlet in a direction transverse to said stream to retard predetermined articles of said stream relative to said conveyor means by drawing said predetermined articles against said surface and for subsequently removing suction to release said articles after a predetermined period, so that said conveyor means conveys spaced groups of abutting articles downstream of said suction outlet.

2. Apparatus as claimed in claim 1, including means for feeding articles onto said conveyor means so that a stream of spaced articles is conveyed towards said suction outlet, wherein the groups of abutting articles are assembled by retarding the predetermined leading article of each group relative to the succeeding articles of the groups.

3. Apparatus as claimed in claim 2, wherein said feeding means includes first and second means for feeding articles onto said conveyor means at spaced positions, to form a stream having a predetermined sequence of articles from said first and second feeding means.

4. Apparatus as claimed in claim 1, including means for actuating said suction means periodically.

5. Apparatus as claimed in claim 1, wherein the suction means includes a manifold, passage means leading from the manifold to said suction outlet, and valve means for blocking said passage means.

6. Apparatus as claimed in claim 5, wherein said valve means includes a rotor rotatable about an axis transverse to the conveyance direction of said stream.

7. Apparatus as claimed in claim 5, wherein said passage means is short relative to a radius of said means.

8. Apparatus for assembling rod-like articles, the apparatus comprising endless band conveyor means for conveying a stream of rod-like articles in an endwise direction; guide means spaced above and extending along said conveyor means, said guide means including a surface having an arcuate cross section adapted to partly surround and guide articles in said stream on said conveyor means; at least one suction outlet in said surface; and means for applying suction to said outlet in a direction transverse to said stream to retard predetermined articles of said stream relative to said conveyor means by drawing said predetermined articles against said surface and for subsequently removing suction to release said articles after a predetermined period so that said conveyor means conveys spaced groups of abutting articles downstream of said suction outlet; first means for feeding articles onto said conveyor means at a first position to form a stream of spaced articles on the conveyor means, second means for feeding second articles onto said conveyor means at a second position, downstream of said first position, so that second articles are intercalated with the first articles on said conveyor means, wherein said arcuate surface extends at least from said second position to said suction outlet, whereby the articles on said conveyor means are guided and aligned by the arcuate surface during intercalation and retarding.

9. Apparatus as claimed in claim 8, wherein the guide means comprises a channel section over said conveyor means.

10. Apparatus for assembling rod-like articles, the apparatus comprising endless band conveyor means for conveying a stream of rod-like articles in an endwise direction; guide means spaced above and extending along said conveyor means, said guide means including a surface having an arcuate cross section adapted to partially surround a plurality of articles in said stream on said conveyor means; at least one suction outlet in said surface; means for applying suction to said outlet in a direction transverse to said stream to retard predetermined articles of said stream relative to said conveyor means by drawing said predetermined articles against said surface and for subsequently removing suction to release said articles after a predetermined period so that the conveyor means conveys spaced groups of abutting articles downstream of said suction outlet; first means for feeding first articles onto said conveyor means at a first position to form a stream of spaced articles on the conveyor means; second means for feeding second articles onto said conveyor means at a second position, downstream of said first position, so that second articles are intercalated with the first articles on said conveyor means; said arcuate surface extends at least from said second position to said suction outlet, whereby the articles on said conveyor means are guided during intercalation and retarding; said endless band conveyor means is adapted to retain articles by means of suction, including means for supplying suction to said conveyor means in the region between said second position and said suction outlet to provide additional control for articles on the conveyor means in said region.

11. Apparatus for assembling rod-like articles, comprising endless band conveyor means for conveying a stream of rod-like articles in an endwise direction, means for applying suction to said conveyor means to retain articles on said conveyor means, means for feeding a stream of articles onto said conveyor means, retarding means for retarding predetermined articles of the stream on said conveyor means relative to said conveyor means, guide means spaced above and extending along said conveyor means between said feeding means and said retarding means, said guide means at least partly defining a path for said stream on said conveyor means, and means for applying increased suction to said conveyor means in a region extending from said feeding means to said retarding means to provide additional control for the articles of said stream in said region.

* * * * *